US006759085B2

(12) United States Patent
Muehlberger

(10) Patent No.: US 6,759,085 B2
(45) Date of Patent: Jul. 6, 2004

(54) METHOD AND APPARATUS FOR LOW PRESSURE COLD SPRAYING

(75) Inventor: Erich Muehlberger, San Clemente, CA (US)

(73) Assignee: Sulzer Metco (US) Inc., Westbury, NY (US)

( * ) Notice: Subject to any disclaimer, the term of this patent is extended or adjusted under 35 U.S.C. 154(b) by 0 days.

(21) Appl. No.: 10/174,446

(22) Filed: Jun. 17, 2002

(65) Prior Publication Data

US 2003/0232132 A1 Dec. 18, 2003

(51) Int. Cl.[7] ..... B05D 1/02

(52) U.S. Cl. ..... 427/189; 427/191; 427/202; 427/294; 427/421

(58) Field of Search ..... 427/189, 191, 427/192, 199, 202, 205, 294–296, 421–427; 118/50, 308, 310

(56) References Cited

U.S. PATENT DOCUMENTS 5,225,655 A 7/1993 Muehlberger ..... 219/121.47
5,234,723 A * 8/1993 Babacz
5,302,414 A * 4/1994 Alkhimov et al.
5,795,626 A 8/1998 Gabel et al. ..... 427/458

* cited by examiner

*Primary Examiner*—Fred J. Parker
(74) *Attorney, Agent, or Firm*—Hogan & Hartson, LLP

(57) ABSTRACT

A cold spraying process for forming a coating of powder particles sprayed in a gas substantially at ambient temperature onto a workpiece is improved by placement in a low ambient pressure environment in which the pressure is substantially less than atmospheric pressure. The low pressure environment acts to substantially accelerate the sprayed powder particles, thereby forming an improved coating of the particles on the workpiece. The low ambient pressure environment is provided by a vacuum tank coupled to a vacuum pump and having both the workpiece and a cold spray gun located therein. The cold spray gun is coupled to a source of pressurized inert gas as well as to a feeder for providing a flow of the powder to be sprayed. A gas compressor downstream of the vacuum pump compresses gas from the vacuum tank for recycling to the source of pressurized gas. The source of pressurized gas is coupled to the cold spray gun where it may be heated by passing through a heating coil coupled to a source of electrical power, before being sprayed from a nozzle onto the workpiece. An arrangement of valves and injection ports enables the powder flow to be introduced at a selected one of a plurality of locations along the heating coil and the nozzle.

10 Claims, 3 Drawing Sheets

METHOD AND APPARATUS FOR LOW PRESSURE COLD SPRAYING

BACKGROUND OF THE INVENTION

1. Field of the Invention

The present invention relates to cold spraying methods and apparatus in which powder in a gas flow is sprayed under pressure onto a workpiece at or close to the ambient temperature, to form a coating of the powder on the workpiece.

2. History of the Prior Art

It is well known in the art to form coatings of metals or other materials by spraying a powder or other particulate form of the material using a plasma system. Plasma systems spray the particulate material through a nozzle located within a plasma chamber, under very high temperatures and high pressures. The pressures combine with vacuum pumps or other sources of low pressure downstream of the plasma chamber to form a plasma flame. The powder or other particulate matter which is introduced into or close to the nozzle is heated to melt or near melt and forms a part of the flame. The plasma flame carries the molten material to a workpiece located downstream of the nozzle within the plasma chamber, where a dense coating of the material is formed on the workpiece. Such plasma systems have found widespread use for certain applications such as the refurbishment of aircraft engine parts, where a dense coating of metal or other material must be formed on the parts. An example of such systems is provided by U.S. Pat. No. 5,225,655 of Muehlberger, which issued Jul. 6, 1993.

Because of the extreme conditions under which plasma systems operate, they are typically expensive to build and consume considerable space. Consequently, less expensive and more compact systems have been investigated.

One alternative system which has gained favor for certain applications is the so-called cold spray system. Cold spray systems introduce a gas such as an inert gas under pressure into a cold spray gun. The powder or other particulate to be sprayed is also introduced into the cold spray gun where it mixes with the pressurized gas for eventual discharge from the gun, such as through a spray nozzle. The gas is sometimes heated to a desired extent, and the powder is often introduced into the heated gas at a point where it is also subjected to a desired amount of heating. The mixture of gas and powder exits the cold spray gun under pressure and is sprayed onto an adjacent workpiece to form the desired coating thereon. By definition, the gas which has exited the cold spray gun is relatively cool, in cold spray systems. Typically, the gas is at or close to the ambient temperature outside of the cold spray gun. While the powder is typically heated to some extent (but not to the extent that oxidation occurs), it is not heated to melt as in the case of plasma systems nor is it even heated to the softening point of the powder. Nevertheless, the temperatures and pressures which are present as the spraying occurs combine to form a relatively dense coating of the material of the powder on the workpiece. An example of a conventional cold spray system is provided by U.S. Pat. No. 5,302,414 of Alkhimov et al., which issued Apr. 12, 1994.

Cold spray processes provide certain advantages over plasma systems, beyond the fact that they are more compact and less expensive. Such advantages relate to the relatively cool temperatures of the spray and the fact that the powder particles are not molten. Molten powder tends to coat and sometimes clog various parts, passages and orifices which are not intended to be coated with the powder material. This creates a maintenance problem for the equipment, and in some cases greatly shortens the life span thereof. Also, cold spraying is better for certain compounds which are affected by high heat and oxidation.

While conventional cold spray processes are suitable for many applications, there is room for improvement. One area has to do with the density and uniformity of the coatings created on the workpiece. Because of the relatively low temperatures and the relatively low pressure of the spray directed onto the workpiece, the coating formed on the workpiece may have less than desirable or acceptable density or uniformity for certain applications. Also, it would be desirable to provide a spray system with greater versatility so that heating of the gas and of the powder particles within the cold spray gun can be varied relative to one another to optimize conditions. A still further area of possible improvement relates to conservation of the inert gases typically used in such systems. The inert gases such as helium which are often used in such systems tend to be relatively expensive. Consequently, it would be desirable to be able to conserve on the amount of new gas which must be introduced into the system for various spraying operations.

BRIEF SUMMARY OF THE INVENTION

Briefly stated, the present invention provides improved methods and apparatus for cold spraying. In particular, the present invention provides for low pressure cold spraying methods and apparatus which are highly advantageous over conventional cold spraying methods and apparatus. To accomplish this, the cold spray is introduced into an ambient pressure which is substantially less than atmospheric pressure. This results in substantial acceleration of the gas and included powder particles or other particulate exiting the cold spray gun, with the result that denser and more uniform coatings are formed on the workpiece.

In accordance with a further aspect of the invention, gas and powder mixture from the workpiece is filtered before being fed to a compressor which compresses the inert gas. The compressed inert gas is then recycled to the source of such gas for reuse in subsequent cold spraying operations. This results in the realization of considerable savings in the amount of expensive inert gas which is often used for best results.

In accordance with a still further aspect of the invention, the gas is fed through a heating coil within the cold spray gun for heating of the gas by a certain amount prior to exiting through a nozzle at the end of the gun. At the same time, an arrangement of valves and injection points at various locations along the heating coil and within the nozzle enable powder to be introduced at a selected one of a plurality of different locations along the heating coil and within the nozzle. In this manner, heating of the powder and of the gas can be varied relative to each other to achieve optimal results.

In a cold spraying method according to the invention, a spraying orifice is provided adjacent a workpiece to be sprayed. The orifice may be provided by a spray nozzle. Particulate matter is provided under pressure to the orifice as is an inert gas under pressure. The inert gases are provided under pressure so as to establish a static pressure at the orifice and provide a spray of particulate matter and gas onto the workpiece. The orifice is located in a region of ambient pressure which is substantially less than the static pressure at the orifice, to provide substantial acceleration of the spray of particulate matter and gas onto the workpiece. The inert gas may be heated before introduction into the orifice, preferably by exposing the gas to a temperature of 0° C.–1000° C. The static pressure at the orifice may be within a range of 1–20 atmospheres, and the region of low ambient pressure preferably has a pressure in the range of less than 1 atmosphere to 0.00001 atmosphere. The powder particles preferably have a size of 20–0.5 microns.

In accordance with the invention, the method may include the further step of recycling all of the inert gas from the workpiece, thereby conserving on the expensive inert gas which is typically used.

The providing of heated gas under pressure may be accomplished by providing a source of pressurized gas, coupling the source of pressurized gas to the nozzle or other object for providing the orifice, through a heater tube, and heating the heater tube to heat the gas. A flow of powder particles is introduced into the gas at one of a plurality of selected points of introduction along the heater tube and the nozzle as determined by an amount of desired heating of the powder particles before introduction at the nozzle, relative to the heating of the gas provided by the heater tube.

A cold spray gun in accordance with the invention includes an enclosed casing having a hollow interior, a spray nozzle mounted in a wall of the casing, a hollow coil mounted in the casing and coupled to the spray nozzle, a gas supply coupled to the hollow coil, a source of electrical power coupled to the hollow coil to provide heating thereof, and a powder feeder. A plurality of valves and injection ports are coupled to the powder feeder for delivering powder to one of various locations along the hollow coil and within the nozzle.

The enclosed casing may have a reflective interior surface so as to enhance the heating of the gas within the hollow coil. A pressure substantially lower than atmospheric pressure is established at the spray nozzle outside of the enclosed casing to provide substantial acceleration of the exiting particles and greatly enhance the coating formed on the workpiece.

The pressure substantially lower than atmospheric pressure established at the spray nozzle outside of the enclosed casing is preferably provided by an enclosed tank having the workpiece and the cold spraying gun mounted therein, in conjunction with a vacuum pump coupled to the tank. Whereas the cold spray gun has a nozzle with an orifice therein, and preferably a pressure of 1–20 atmospheres at the orifice, the pressure substantially lower than atmospheric pressure at the outside of the gun is preferably in the range of less than 1 atmosphere to 0.00001 atmosphere.

The enclosed tank may be coupled through a filter arrangement to a vacuum pump. The filter arrangement filters particulate matter from the overspray at the workpiece, and the vacuum pump produces the tank's ambient pressure which is substantially less than atmospheric pressure. A compressor downstream of the vacuum pump compresses the gas from the workpiece which is drawn through the filter arrangement and through the vacuum pump, to provide compressed gas to the source of pressurized gas flow to the cold spray gun.

The powder flow may be provided by apparatus which includes an arrangement of valves and powder injection ports for introducing the powder flow at a selected one of a plurality of locations along the heating coil to provide a desired amount of heating of the powder flow before being sprayed by the cold spray gun onto the workpiece.

DETAILED DESCRIPTION OF THE INVENTION

Figure 1:
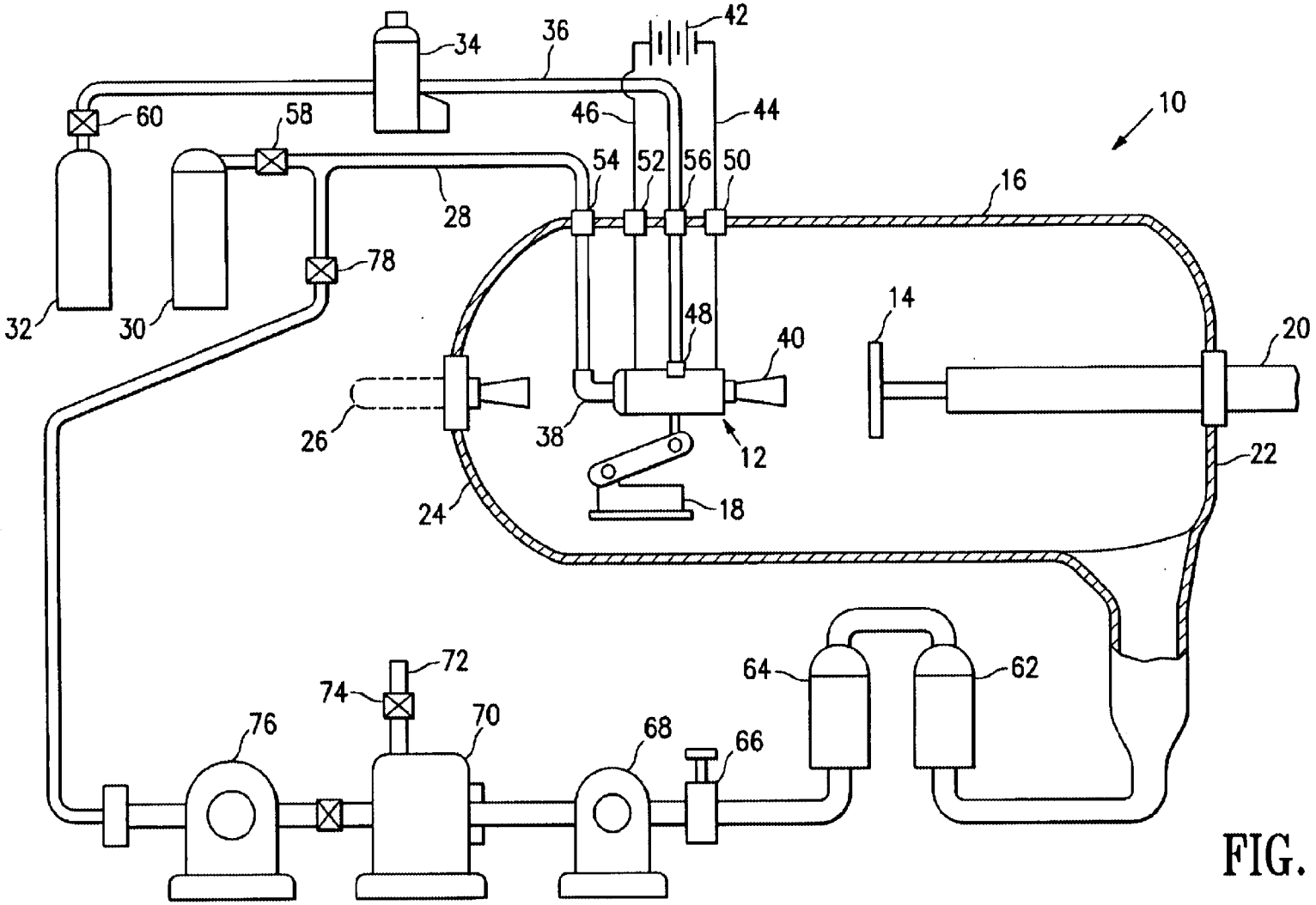
FIG. 1 is a schematic diagram of a preferred embodiment of a low pressure cold spray system in accordance with the invention.

FIG. 1 shows a low pressure cold spray system 10 in accordance with the invention. The system 10 includes a low pressure cold spray gun 12 (shown in detail in FIG. 2) which is mounted together with a workpiece 14 within the hollow interior of a vacuum tank 16. The low pressure cold spray gun 12 is disposed relative to the workpiece 14 for directing a spray onto the workpiece 14, and is movable relative thereto by a gun manipulation robot 18 disposed within the vacuum tank 16 and mounting the low pressure cold spray gun 12. The workpiece 14 is also movable relative to the low pressure cold spray gun 12 by way of a workpiece manipulation device 20 mounted in an end wall 22 of the vacuum tank 16 and extending into the interior of the vacuum tank 16 so as to mount the workpiece 14 thereon.

As noted above, the low pressure cold spray gun 12 can be moved so as to adjust the position thereof relative to the workpiece 14 using the gun manipulation robot 18. The workpiece 14 is itself adjustable in position within the interior of the vacuum tank 16 by way of the workpiece manipulation device 20. Where desired, the low pressure cold spray gun 12 may be fixedly mounted within an end wall 24 of the vacuum tank 16 opposite the end wall 22, as shown by the dotted outline position 26 in FIG. 1. With the low pressure cold spray gun 12 mounted within the end wall 24 in a fixed position, the workpiece manipulation device 20 is used to locate the workpiece 14 at a desired position relative to the low pressure cold spray gun 12.

The low pressure cold spray gun 12 produces a cold spray for direction onto the workpiece 14 in response to a main gas flow under pressure and a powder gas which carries a powder or other particulate matter therein. The main gas flow is provided to the low pressure cold spray gun 12 by a main gas line 28 from a first gas supply in the form of a storage container 30. The main gas typically comprises an inert gas such as argon or helium and other gases such as nitrogen, hydrogen, or any mixtures thereof. The powder or other particulate matter is provided in a flow of gas by a second gas supply or storage container 32 in combination with a powder feeder 34. The second gas storage container 32 provides a flow of powder gas through a powder gas line 36 extending through the powder feeder 34. The powder feeder 34 feeds the powder into the flow of gas in the powder gas line 36 for feeding of the powder to the low pressure cold spray gun 12.

Figure 2:
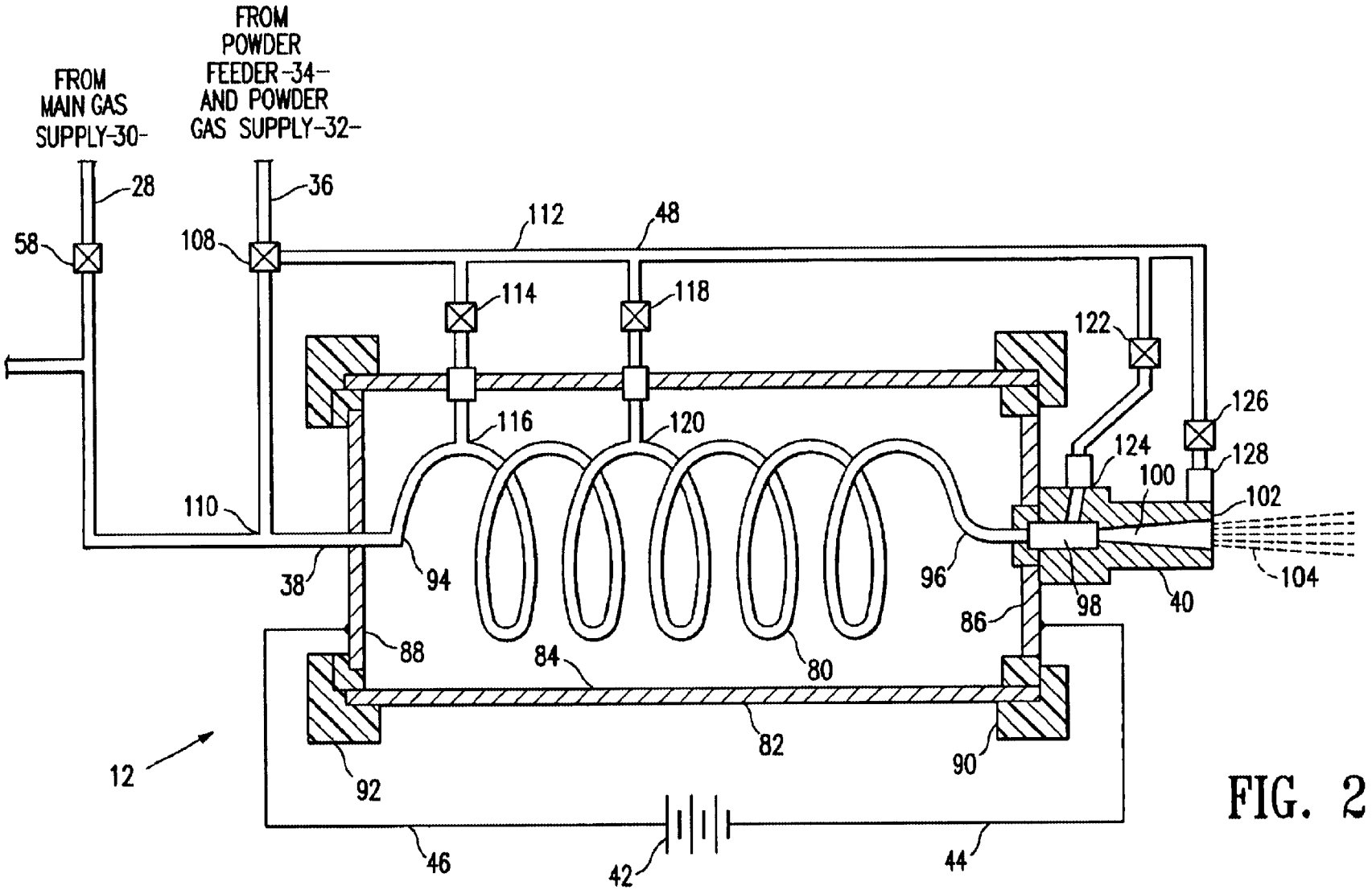
FIG. 2 is a partial schematic and partial cross-sectional view of a preferred embodiment of a low pressure cold spray gun for use in the system of FIG. 1.

As described in detail hereafter in connection with FIG. 2, the gas from the first gas storage container 30 flows through the main gas line 28 to an input end 38 of the low pressure cold spray gun 12. From the input end 38, the gas flows through a heating coil to a spray nozzle 40 at an opposite end of the low pressure cold spray gun 12 from the input end 38. The heating coil is heated to heat the gas flowing therethrough by a desired amount, and this is provided by an electrical power supply 42 coupled to opposite ends of the low pressure cold spray gun 12. As shown in FIG. 1, opposite power cables 44 and 46 couple the electrical power supply 42 to the opposite ends of the low pressure cold spray gun 12.

As previously described, the powder feeder 34 feeds powder into the flow of powder gas traveling through the powder gas line 36. As shown in FIG. 1, the powder gas line 36 extends through the wall of the vacuum tank 16 to a connecting point 48 along the low pressure cold spray gun 12. However, as described in detail in connection with FIG. 2, the powder gas with the powder therein may be applied to any of a plurality of different injection ports along the heating coil within the low pressure cold spray gun 12 and the spray nozzle 40. This enables the powder to be selectively heated by a desired amount in conjunction with the heating of the main gas, before a spray of the gas and powder is formed at the spray nozzle 40.

As shown in FIG. 1, the power cables 44 and 46 are coupled through the wall of the vacuum tank 16 at fittings 50 and 52 respectively. The main gas line 28 is coupled to the low pressure cold spray gun 12 through a fitting 54 in the wall of the vacuum tank 16. The powder gas line 36 is coupled to the low pressure cold spray gun 12 through a fitting 56 in the wall of the vacuum tank 16. The main gas line 28 includes a valve 58 located between the first gas storage container 30 and the fitting 54. The powder gas line 36 has a valve 60 located between the second gas storage container 32 and the powder feeder 34. The valves 58 and 60 may be used to control the flow of gas from the first and second gas storage containers 30 and 32 respectively.

The low pressure cold spray gun 12 produces a cold spray which is directed onto the workpiece 14. Although the gas is typically heated within the low pressure cold spray gun 12, the exiting spray is at or relatively close to the ambient temperature within the interior of the vacuum tank 16. At the same time, the cold spray is exposed to an ambient pressure within the interior of the vacuum tank 16 which is substantially less than atmospheric pressure. Whereas the low pressure cold spray gun 12 has a total or static pressure at the entrance to the throat of the spray nozzle 40 which is higher than the ambient pressure outside of the low pressure cold spray gun 12, a substantial pressure differential is provided by introducing the cold spray into an atmosphere of greatly reduced pressure within the vacuum tank 16. Such pressure differential provides substantial acceleration of the gas (supersonic flow) and the powder particles with a resulting improved coating of the spray material onto the workpiece 14, and this in spite of the relatively cool temperatures characterizing the cold spray process.

The low ambient pressure environment within the vacuum tank 16 is created by coupling the interior of the tank 16 through a filter arrangement comprised of filters 62 and 64 and a valve 66 to a vacuum pump 68. The vacuum pump 68 provides the low ambient pressure within the hollow interior of the vacuum tank 16. It also acts to draw the flow of gas and powder particles that pass beyond the workpiece 14, to the filters 62 and 64 where the powder is removed from the gas. The gas is drawn through the valve 66 and the vacuum pump 68 to a forepump 70 having an exhaust line 72 with a valve 74 therein. The forepump 70 provides the gas to a gas compressor 76 which is coupled through a valve 78 to the main gas line 28 at a point downstream of the valve 58 in the main line gas line 28. Gas which reaches the vacuum pump 68 is passed to the forepump 70 which pumps it to the gas compressor 76. The gas compressor 76 compresses the gas before recycling the gas through the valve 78 to the main line gas line 28. The mix of recycled gas from the gas compressor 76 and new gas from the first gas storage container 30 is adjusted using the valves 78 and 58 to provide the desired gas flow through the main gas line 28 to the low pressure cold spray gun 12.

The ability to save and recycle the gas from the overspray at the workpiece 14 is a highly advantageous feature in accordance with the invention. The gas typically used tends to be relatively expensive, particularly in cases where inert gases such as helium are used. The ability to save and recycle such gases represents substantial cost saving.

The low pressure cold spray gun 12 is shown in detail in FIG. 2. As shown therein, the gun 12 includes a hollow heating coil 80 mounted within the hollow interior of an enclosed casing 82 of general cylindrical configuration. The casing 82 has a reflective inner surface 84 for enhancing the heating of the coil 80 provided by the electrical power supply 42. The electrical power supply 42 is coupled to opposite ends of the heating coil 80 by way of opposite end walls 86 and 88. The end walls 86 and 88 are electrical insulated from each other by being mounted at opposite ends of the casing 82 using insulators of circular configuration. A first such insulator 90 mounts the end wall 86 within one of the opposite ends of the casing 82. A second insulator 92 mounts the opposite end wall 88 to the opposite end of the casing 82. A first end 94 of the heating coil 80, which is coupled to the main gas line 28 at the input end 38, is also electrically coupled to the end wall 88 so as to be electrically coupled by the power cable 46 to one end of the electrical power supply 42. An opposite second end 96 of the heating coil 80 is mounted within the end wall 86 for electrical coupling via the power cable 44 to the other end of the electrical power supply 42. The spray nozzle 40 is mounted within a central portion of the end wall 86 where it is coupled to the second end 96 of the heating coil 80.

While it is not essential that the gas provided by the main gas line 28 be heated prior to introduction into the nozzle 40, better results are realized if the gas is heated. This is accomplished by passing the gas through the hollow interior of the heating coil 80 prior to introduction into the spray nozzle 40. The electrical power supply 42 is chosen to provide a desired amount of heating of the gas by the heating coil 80.

The spray nozzle 40 has a throat section 98 coupled to the second end 96 of the heating coil 80. The throat section 98 is coupled to a diverging section 100 of the spray nozzle 40. The diverging section 100 extends from the throat section 98 to an output end 102 of the spray nozzle 40 from which the cold spray exits. The cold spray is illustrated by a series of dashed lines 104 in FIG. 2.

As previously noted, the second gas storage container 32 provides a flow of powder gas to the powder feeder 34, where powder is introduced into the gas flow. The powder gas line 36 then carries the flow of powder gas with powder therein to the low pressure cold spray gun 12. In accordance with the invention, the flow of powder may be introduced into the low pressure cold spray gun 12 at a selected one of a plurality of different locations along the heating coil 80 and within the spray nozzle 40. This is illustrated in FIG. 2 by an arrangement which includes a plurality of valves and powder injection ports. A first such valve 108 is coupled to the powder gas line 36 so as to selectively provide the powder flow to an injection port 110 at the input end 38 of the gun 12 adjacent the first end 94 of the heating coil 80. The valve 108 also provides the ability to bypass the injection port 110 in favor of a powder feed line 112. The powder feed line 112 is coupled through a valve 114 to an injection port 116, a short distance downstream of the first end 94 of the heating coil 80. The powder feed line 112 is also coupled through a valve 118 to an injection port 120 at a midway point along the heating coil 80. The powder feed line 112 is further coupled through a valve 122 to an injection port 124 at the throat section 98 of the spray nozzle 40 and through a valve 126 to an injection port 128 within the diverging section 100 of the spray nozzle 40 adjacent the output end 102. The arrangements of valves 108, 114, 118, 122 and 126 provides the ability to inject the powder at any of the injection ports 110, 116, 120, 124 and 128. In this manner, the powder can be injected at a selected location along the length of the heating coil 80, or within the throat section 98 or the diverging section 100 of the spray nozzle 40. This enables the introduced powder to be heated by varying amounts for the given heating of the gas from the main gas line 28. As previously noted, the electrical power supply 42 is selected to provide a desired amount of heating of the gas within the heating coil 80. By introducing the powder at the injection port 110 at the input end 38 of the low pressure cold spray gun 12, on the one hand, the powder is caused to flow through the entire length of the heating coil 80 and the spray nozzle 40 so as to maximize the heating of the powder particles. At the other extreme, introduction of the powder at the throat section 98 or particularly the diverging section 100 provides a minimum amount of heating of the powder particles.

A certain amount of heating of the powder prior to the spraying thereof is usually desirable in order to provide a better coating of the spray material on the workpiece 14. In cold spray applications, however, the powder particles must not be heated to such an extent that they melt. The arrangement shown in FIG. 2 provides the ability to heat the powder particles in various degrees while at the same time accomplishing a desired amount of heating of the gas.

Figure 3:
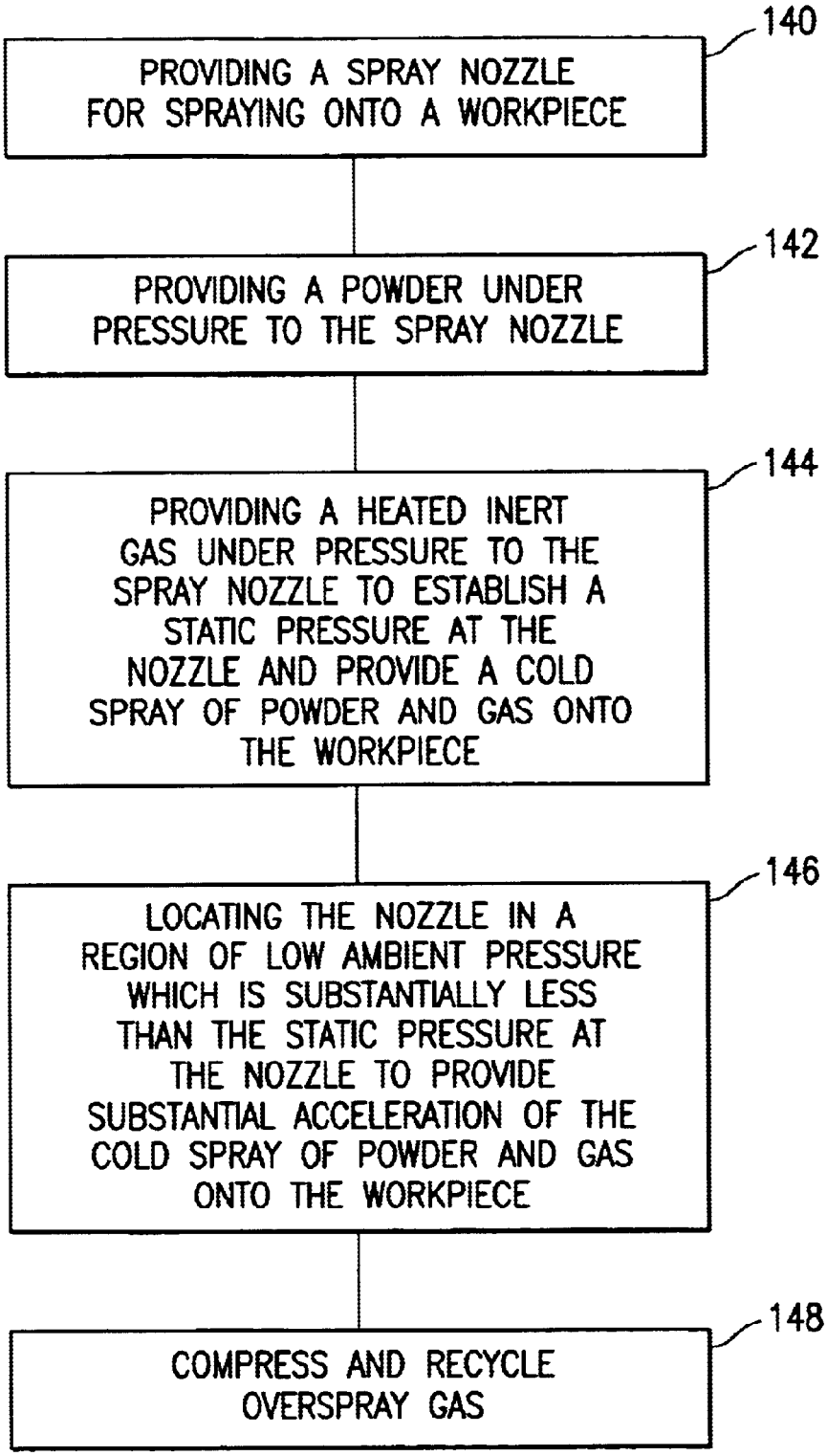
FIG. 3 is a block diagram of the successive steps of a preferred method for low pressure cold spraying in accordance with the invention.

FIG. 3 is a block diagram of the successive steps of a preferred method of low pressure cold spraying in accordance with the invention. In a first step 140, a spray nozzle is provided for spraying onto a workpiece. This is illustrated by the spray nozzle 40 and the workpiece 14 in FIGS. 1 and 2. In actuality, the cold spray from the low pressure cold spray gun 12 can be directed onto the workpiece 14 without using a spray nozzle as such, so long as the spray gun has a spraying orifice for spraying the cold spray. However, a spray nozzle 40 is preferred for most applications.

In a second step 142 shown in FIG. 3, powder is provided under pressure to the spray nozzle. This is illustrated in FIGS. 1 and 2 by the flow of powder gas from the second gas storage container 32 through the powder feeder 34 to the various points of introduction of the powder within the low pressure cold spray gun 12. Regardless of where the powder spray is introduced within the spray gun 12, it is delivered under pressure to the spray nozzle 40.

In a third step 144 shown in FIG. 3, a heated inert gas under pressure is provided to the spray nozzle to establish a static pressure at the nozzle and provide a cold spray of powder and gas onto the workpiece. As illustrated in FIGS. 1 and 2, the first gas storage container 30 provides pressurized gas via the main gas line 28 to the input end 38 of the low pressure cold spray gun 12, for delivery of the gas by the heating coil 80 to the spray nozzle 40. This establishes a static pressure Pt at the entrance into the throat section 98 of the spray nozzle 40. The powder which is introduced into the low pressure cold spray gun 12 at a selected location, is sprayed from the spray nozzle 40 as a cold spray onto the workpiece 14.

In a fourth step 146 shown in FIG. 3, the spray nozzle 40 is located in a region of low ambient pressure substantially less than the static pressure at the throat section of the nozzle, to provide substantial acceleration of the cold spray of powder and gas onto the workpiece. This is illustrated in FIGS. 1 and 2 in which the low pressure cold spray gun 12 with its included spray nozzle 40 is located within the vacuum tank 16. The vacuum tank 16, which is coupled downstream thereof to the vacuum pump 68, has an ambient pressure therein which is substantially less than the static pressure at the throat section of the nozzle 40, and this acts to greatly accelerate the powder particles and thereby greatly enhance the coating thereof formed on the workpiece 14.

In accordance with the invention, the conditions of gas and powder delivery to the low pressure cold spray gun 12 are chosen to produce a static pressure Pt (absolute pressure) at the entry into the nozzle throat section 98 of 1–20 atmospheres. Nominally, the static pressure Pt is at a value of approximately 10 atmospheres. At the same time, the vacuum tank 16 with its downstream vacuum pump 68 is chosen to provide an ambient pressure P (absolute pressure) within the tank in the range of less than 1 atmosphere to 0.00001 atmosphere (380 Torr.-0.0076 Torr.; 38000° microns–7.6 microns). A static pressure Pt which is at or greater than atmospheric pressure and typically on the order of about 10 atmospheres combines with a tank ambient pressure of less than atmospheric pressure to provide a substantial pressure differential within the cold spray exiting from the spray nozzle. In this manner, particle acceleration and the resulting coating on the workpiece are greatly enhanced in spite of the system being a cold spray system.

The size of the powder particles can be varied as desired. However, best results are achieved by powder particles in a size range of 20–0.5 microns. Also, and as previously noted, it is not essential that the inert gas be heated, but better results are achieved when it is. In this regard, the heating coil 80 is preferably heated to a temperature within the range of 0° C.–1000° C.

By locating the cold spray process in a low ambient pressure environment in accordance with the invention, certain advantages are realized. These advantages are illustrated by the examples which follow. At a static pressure Pt of only 10 atmospheres (147 psia), the gas exit velocity is increased due to the high pressure ratio of the total pressure in the gun to the exiting ambient pressure. The gas exit velocities are increased, and the particle velocities are also increased. The spray process is totally contained, is noise free and is dust free. Because of the lower total pressure within the gun, the gas mass flow is reduced up to one-third when compared to equal Mach numbers (gas exit velocities) at atmospheric ambient pressure. Powder overspray collection is easily and efficiently carried out, and the recycling of expensive gases such as helium is accomplished, simply by adding a gas compressor stage within the system. At lower ambient pressures, the spray nozzle 40 can be eliminated, to increase the spray jet and thereby cover larger workpieces and workpiece areas. Use of inert gas and the inert atmosphere provided thereby allows for heating of the powder without oxidation.

As previously noted, the gases used in processors and apparatus according to the invention are preferably inert gases, such as helium. In the case of helium, the gas may be provided at a temperature of 650° K, such that $\delta$=1.67, and the speed of sound is 5000 ft./sec. or 1520 m/sec.

The following examples involve data which is calculated based, in part, on known characteristics and values of spray systems. Particle speed varies with particle size, and is less than the gas speed. For particle sizes of 0.5–20 microns preferred in the present invention, the particle speed is assumed to be at least 50% of the gas speed for the larger particle sizes and equal to a larger percentage of the gas speed for the smaller particle sizes.

Definitions of the various terms referred to in the examples are as follows:

ht=Average Plasma Enthalpy

*=Throat Condition (Mach=1.0)

P=Absolute Pressure in Spray Tank $P_t$=Absolute Pressure in Gun (At Throat Entrance)

A=Cross-sectional Area of Nozzle Exit

A*=Cross-sectional Area of Nozzle Throat a*=Speed of Sound in Nozzle Throat

M=Mach Number

V=Flow Exit Velocity

T=Average Plasma Stream Static Temperature $T_t$=Average Plasma Stagnation Temperature (At Throat Entrance)

$P_{t1}$=Absolute Pressure Before Shock Wave (Assumed Same as $P_t$)

$P_{t2}$=Absolute Pressure After Shock Wave (Maximum Recovered Pressure at Substrate if Ideal Nozzle is Used)

δ=Ratio of Specific Heats

EXAMPLE 1

In this instance, nitrogen is used as the gas, at a temperature of 650° K, such that δ=1.3 and the speed of sound is 1700 ft./sec. or 517 m/sec. The total or throat pressure Pt is 10 atm. (147.0 psi a or 132.3 psi g). The flow of nitrogen ($N_2$) is 252 scfh. The ambient tank pressure P is 0.1 atmospheres or 76 Torr. Thus, $$\frac{P}{Pt} = 0.01,$$

the Mach Number $$M = 3.55,\ \frac{V}{A^*} = 2.23,\ \frac{A}{A^*} = 9.64,\ \frac{T}{Tt} = 0.3460,\ \text{and}\ \frac{Pt_2}{Pt} = 0.1592.$$

The exit gas velocity is 3800 ft./sec. or 1155 m/sec. The ambient gas temperature is 225° K. The nozzle throat diameter is 0.0465 inches, and the size of the nozzle exit is 0.144 inches.

In conventional cold spray systems, a total pressure Pt of as much as 500 psig is needed in order to achieve a Mach Number M of 2.0. But as illustrated by the above figures, in the case of the invention a Mach Number of M=3.55 is achieved with a static pressure Pt of 132.3 psig. This is due principally to the presence of the lower ambient pressure outside of the spray gun.

EXAMPLE 2

To take advantage of the temperature decrease at Mach 3.5 to the ambient temperature, the gas temperature Tt at the throat section of the nozzle can be increased to 100020 K. At this stagnation temperature, the speed of sound is 2100 ft./sec. The gas exit velocity in this case is 4686 ft./sec. or 1424 m/sec. The ambient gas temperature of the exiting flow (static temperature) is 346° K which is hotter than in the case of Example 1 but still below oxidation temperatures.

EXAMPLE 3

By reducing the nozzle throat diameter to 1 mm or 0.0409 inches, which is a dimension often used in conventional cold spray systems, the nitrogen mass flow reduces at equal total pressure to 195 scfm of nitrogen at spray conditions which are otherwise the same. The nozzle exit size is 0.126 inches, at the same Mach Number.

EXAMPLE 4

If the ambient pressure is further reduced to P=7.6 Torr., $$\frac{P}{Pt} = 0.001.$$

The temperature Tt=1000° K, and then the speed of sound is 2100 ft./sec. This produces a Mach Number of $$M = 5.11,\ \frac{V}{A^*} = 2.47,\ \frac{A}{A^*} = 5.13,\ \frac{T}{Tt} = 0.203,\ \text{and}\ \frac{Pt_2}{Pt_1} = 0.03247.$$

The gas exit velocity is 5187 ft./sec. or 1577 m/sec. The gas static temperature is 203° K (below freezing). The nozzle exit diameter is 0.292 inches and the throat diameter is 0.0409 inches. Under these conditions, the powder must be injected into the throat of the nozzle.

EXAMPLE 5

In this case, the gas stagnation temperature is raised to 1500° K. The speed of sound is then 2500 ft./sec. The Mach Number is $$M = 5.11,\ \frac{V}{A^*} = 2.47,\ \frac{A}{A^*} = 5.13,\ \frac{T}{Tt} = 0.203,\ \text{and}\ \frac{Pt_2}{Pt_1} = 0.03247.$$

The gas exit velocity is 6175 ft./sec. or 1877 m/sec, Pt=10 atm, P=7.6 Torr. (0.01 atm), the gas static temperature of the exiting stream is 304.5° K (nearly freezing), the throat diameter is 0.0409 inches (1 mm) and the nozzle exit diameter is 0.292 inches.

EXAMPLE 6

In this case the ambient pressure is reduced to 0.76 Torr. (0.001 atm), Pt=10 atm and $$\frac{P}{Pt} = 0.0001.$$

The total gas temperature is 1500° K, the speed of sound is 2500 ft./sec., the Mach Number is 7.0, $$\frac{V}{A^*} = 2.598,\ \frac{A}{A^*} = 287.6,\ \frac{T}{Tt} = 287.6,\ \frac{T}{Tt} = 0.119\ \text{and}\ \frac{Pt_2}{Pt_1} = 0.00604.$$

The gas exit velocity is 6495 ft./sec., or 1974 m/sec. The exit gas ambient temperature is 178.5° K (super cold). The nozzle throat diameter is 0.0409 inches or 1 mm, and the nozzle exit diameter is 0.693 inches.

The particle size is in the range of 10–20 microns, for both metals and oxides. Smaller particles can also be used. Particle injection is in the subsonic section (10 atm). At that gas density, particle speed is a minimum of 50% of the gas exit velocity. Because the low pressure ambient environment is provided by the vacuum tank which is contained, the inert gas is easily captured and reused.

EXAMPLE 7

In this example, helium is used at a temperature Tt of 650° K (377° C. or 709° F.). The speed of sound is 5000 ft./sec.

or 1520 m/sec. The Pt is 10 atm. or 147 psia or 135 psig. The helium gas flow at the throat, which has a size of 1 mm or 0.0406 inches, is 560 scfh. The ambient P=0.1 atm or 76 Torr., $$\frac{P}{Pt} = 0.01,\ M = 3.99,\ \frac{V}{A^*} = 1.83,\ \frac{A}{A^*} = 5.57,\ \frac{T}{Tt} = 0.157 \text{ and } \frac{Pt_2}{Pt_1} = 0.239.$$

With a Mach number of 3.99, the exit gas velocity is 9150 ft./sec. or 2782 m/sec. The exit gas ambient temperature is 102° K (very cold), and the nozzle exit diameter is 0.096 inches.

EXAMPLE 8

In this instance, the gas temperature is 1000° K or 727° C. or 1339° F. The speed of sound is 6000 ft./sec. or 1824 m/sec. The ambient pressure P is 0.01 atm or 7.6 Torr. Pt=10 atm. The nozzle throat is 0.0409 inches or 1 mm. Other values were $$\frac{P}{Pt} = 0.001,\ M = 6.68,\ \frac{V}{A^*} = 1.93,\ \frac{A}{A^*} = 20.9,\ \frac{T}{Tt} = 0.0627, \text{ and } \frac{Pt_2}{Tt_1} = 0.066.$$

For this case which produces a Mach Number of 6.68, the exit gas velocity is 11,580 ft./sec. or 3520 m/sec. The gas ambient temperature was 63° K (super cold). The nozzle exit diameter is 0.186 inches.

If the ambient pressure is further decreased, there is no appreciable gain in the gas exit velocity, inasmuch as $$\frac{V}{A^*}$$

is no longer increasing. Also, the helium gas reaches extremely low exit temperatures on the order of 20° K. At 0.76 Torr. ambient pressure, the Mach number is 10.8 and the nozzle exit diameter at a throat diameter of 1 mm is 0.370 inches.

While particular embodiments of the present invention have been shown and described, it will be obvious to those skilled in the art that changes and modifications may be made without departing from the spirit and scope of the invention.

What is claimed is:

1. A method of spraying particulate matter on a workpiece, comprising the steps of:

providing a spraying orifice adjacent a workpiece to be sprayed;

providing particulate matter under pressure to the spraying orifice;

providing an inert gas under pressure to the spraying orifice to establish a static pressure at the spraying orifice and provide a spray of particulate matter and gas onto the workpiece; and locating the spraying orifice in a region of low ambient pressure which is less than 1 atmosphere and which is substantially less than the static pressure at the spraying orifice to provide substantial acceleration of the spray of particulate matter and gas onto the workpiece and so that the gas exiting the spraying orifice has a temperature substantially at an ambient temperature outside the spraying orifice upon exiting the spray orifice.

2. A method according to claim 1, comprising the further step of recycling the inert gas from the region of low ambient pressure.

3. A method according to claim 1, wherein the step of providing a spraying orifice comprises providing a spray nozzle, and the step of providing particulate matter comprises providing a gas flow having powder therein.

4. A method according to claim 1, wherein the step of providing an inert gas includes heating the inert gas before introducing the inert gas into the spraying orifice.

5. A method according to claim 4, wherein the heating of the inert gas comprises exposing the gas to a temperature of 0° C.–1000° C.

6. A method according to claim 1, wherein the static pressure at the spraying orifice is 1–20 atmospheres and the region of low ambient pressure has a pressure in the range of less than 1 atmosphere to 0.00001 atmosphere.

7. A method of cold spraying a powder onto a workpiece, comprising the steps of:

providing a spray nozzle adjacent a workpiece to be cold sprayed;

providing a flow of powder particles in a gas to the spray nozzle;

providing a heated gas under pressure to the spray nozzle to establish a static pressure of 1–20 atmospheres at the spray nozzle and provide a cold spray of powder particles and gas at a temperature substantially at an ambient temperature outside the spray nozzle upon exiting the spray nozzle;

applying the cold spray of powder particles and gas onto the workpiece; and establishing a static pressure in the range of less than 1 atmosphere to 0.00001 atmosphere outside of the spray nozzle to provide substantial acceleration of the cold spray of powder particles and the heated gas onto the workpiece.

8. A method according to claim 7, wherein the powder particles have a size of 20–0.5 microns.

9. A method according to claim 7, wherein the step of providing a heated gas under pressure comprises exposing the gas to a temperature of 0° C.–1000° C.

10. A method according to claim 7, wherein the step of providing a heated gas under pressure comprises the steps of providing a source of pressurized gas, coupling the source of pressurized gas to the spray nozzle through a heater tube, and heating the heater tube to heat the gas, and wherein the step of providing a flow of powder particles in the heated gas to the spray nozzle comprises the steps of providing a flow of powder particles in a gas, and introducing the flow of powder particles into the gas at one of a plurality of selected points of introduction along the heater tube as determined by an amount of desired heating of the powder particles before introduction at the spray nozzle.

* * * * *